US005356039A

United States Patent [19]

Christine et al.

[11] Patent Number: 5,356,039

[45] Date of Patent: Oct. 18, 1994

[54] PUMP TUBE AND POUCH

[75] Inventors: William C. Christine, Nazareth; Scott A. Roth, Danielsville, both of Pa.

[73] Assignee: Inpaco Corporation, Worthington, Ohio

[21] Appl. No.: 991,373

[22] Filed: Dec. 15, 1992

[51] Int. Cl.[5] ..... B65D 37/00

[52] U.S. Cl. ..... 222/107; 222/207; 222/212; 222/215; 222/490; 222/494; 222/541; 222/545; 222/570; 137/844; 251/900

[58] Field of Search ..... 222/207, 212, 214, 215, 222/107, 491, 490, 494, 541, 570, 569, 545, 567; 383/906, 66; 137/843, 844, 860; 251/5, 900

[56] References Cited

U.S. PATENT DOCUMENTS

| | | | |
|---|---|---|---|
| 2,772,817 | 12/1956 | Jauch | 222/207 |
| 3,066,832 | 12/1962 | Rossetti | 222/207 |
| 3,244,576 | 4/1966 | Swartz | 383/66 X |
| 3,870,201 | 3/1975 | Asplund | 222/207 |
| 4,017,020 | 4/1977 | Frank | 222/541 X |
| 4,085,867 | 4/1978 | Heller | 222/207 X |
| 4,225,062 | 9/1980 | Sneider | 222/567 X |
| 4,256,242 | 3/1981 | Christine | 222/207 |
| 4,286,733 | 9/1981 | Weikert | 222/105 |
| 4,349,133 | 9/1982 | Christine | 222/183 |
| 4,463,876 | 8/1984 | Swallert | 222/94 |
| 4,546,904 | 10/1985 | Frassanito | 222/185 |
| 4,560,093 | 12/1985 | Cassia | 222/214 X |
| 4,570,827 | 2/1986 | Roggenburg, Jr. | 222/95 |
| 4,570,829 | 2/1986 | Allen | 222/181 |
| 4,667,854 | 5/1987 | McDermott et al. | 222/101 |
| 4,887,912 | 12/1989 | Stumpf | 383/66 |
| 4,917,267 | 4/1990 | Laverdure | 222/494 X |
| 4,932,562 | 6/1990 | Christine | 222/96 |
| 5,016,779 | 5/1991 | Williamson | 222/95 |
| 5,072,855 | 12/1991 | Herzig | 222/494 X |

FOREIGN PATENT DOCUMENTS

| | | | |
|---|---|---|---|
| 693485 | 6/1940 | Fed. Rep. of Germany | 222/214 |
| 455511 | 3/1950 | Italy | 222/491 |
| 1136019 | 1/1985 | U.S.S.R. | 222/214 |
| 681324 | 10/1952 | United Kingdom | 222/545 |

*Primary Examiner*—Andres Kashnikow
*Assistant Examiner*—Anthoula Pomrening
*Attorney, Agent, or Firm*—Hill, Steadman & Simpson

[57] ABSTRACT

A pouch for storing and dispensing liquid product in incremental amounts having a body portion and a pump tube portion, wherein the pouch can be held within a dispensing apparatus for squeezing the pump tube portion to release the incremental amounts. The improved pouch provides a pump tube portion made of thermoplastic polypropylene and butyl terpolymer rubber which can be readily sealed to the body without fitments or couplers. The improved pouch provides a built-in "duck bill" check valve assembly or alternatively an O-ring check valve assembly, which further reduces the number of parts required as compared to the prior art. The check valve assembly provides a socket connector for mounting a separate nozzle assembly to the check valve assembly. A break-off tab for initially opening the nozzle assembly for dispensing is provided.

21 Claims, 3 Drawing Sheets

PUMP TUBE AND POUCH

BACKGROUND OF THE INVENTION

The present invention relates generally to a device for holding a liquid product and having a pump tube for dispensing incremental amounts of the product from the device. In particular, the invention relates to a pouch having a pump tube extending from the bottom of the pouch, the pouch and pump tube being installable into a mechanical dispenser which selectively squeezes the pump tube to dispense predetermined incremental amounts of the liquid held within the pouch.

The invention is particularly adapted to hold liquid soap to be installed into a self-dispensing mechanism wherein activation of a push bar or the like dispenses a predetermined amount of liquid soap out of a nozzle arranged at a bottom end of the pump tube. A mechanism for holding the pouch and tube is disclosed in U.S. application Ser. No. 07/826,065, filed Jan. 27, 1992, now U.S. Pat. No. 5,242,083, which is incorporated into the present disclosure by reference.

A number of prior art devices are known to holding liquids that include elongate cylindrical portions extending therefrom for squeezing by a dispensing mechanism. Such devices are illustrated in U.S. Pat. Nos. 4,349,133, 4,463,876, 4,546,904, 4,667,854 and 4,932,562.

In a typical structure, a pouch is provided having a pump tube extending therefrom. A check valve is usually located at a lower end of the pump tube. The check valve comprises four pieces, an upper cap having a valve orifice, a lower cap having a through aperture and a ball fittable over said orifice, and a spring for biasing the ball against said orifice. When the pump tube pressure overcomes the force of the spring, fluid passes through the orifice and out of the aperture.

The check valve is designed to prevent fluid from leaking or dripping from the pump tube. Known check valve structures are not entirely satisfactory due to their complicated structure that makes manufacturing the same time consuming. Additionally, the structure in combination with known pump tubes does not always prevent dripping.

An additional problem with known pouch and tube constructions is that the tube cannot be directly sealed to the pouch. Instead, it is necessary to use a coupler to seal the tube to the pouch.

There is therefore a need for an improved pump tube and pouch construction.

SUMMARY OF THE INVENTION

The present invention provides an improved pouch-/pump tube construction for housing liquid products. To this end, the pump tube can be adhered directly to the body of the pouch without the need for an adaptor. To this end, at least the outer layer of the pouch is constructed from a polyolefin and the pump tube is constructed from a polyolefin compatible therewith.

Additionally, pursuant to the present invention, a novel arrangement for the pump tube is provided. The pump tube includes an integral "duck bill" check valve. Due to the structure and material of the pump tube, the tube achieves characteristics of a latex tube. This allows the tube to be used with a "duck bill" valve and achieve improved characteristics with respect to preventing drips compared to prior devices.

Still further, in an embodiment, an improved socket connection for a nozzle assembly is provided. The socket connection and nozzle assembly provide interlocking means for holding the nozzle assembly to the check valve. The nozzle assembly provides a closed end having a frangible joint and a finger tab portion. The nozzle can be opened for use by grasping the finger tab portion and breaking the nozzle at the frangible joint.

An advantage of the present invention is that is provides an improved pouch and pump tube structure.

Additionally, an advantage of the present invention is that it provides an improved soap dispenser.

Furthermore, an advantage of the present invention is that it provides an improved pump tube for dispensing fluid.

Moreover, an advantage of the present invention is that it provides a tube/pouch structure wherein the tube can be secured directly to the pouch Further, an advantage of the present invention is that it provides a pump tube that does not require a four piece check valve structure.

Additional features and advantages of the present invention are described in, and will be apparent from, the detailed description of the presently preferred embodiments and from the drawings.

DETAILED DESCRIPTION OF THE PRESENTLY PREFERRED EMBODIMENT

Figure 1:
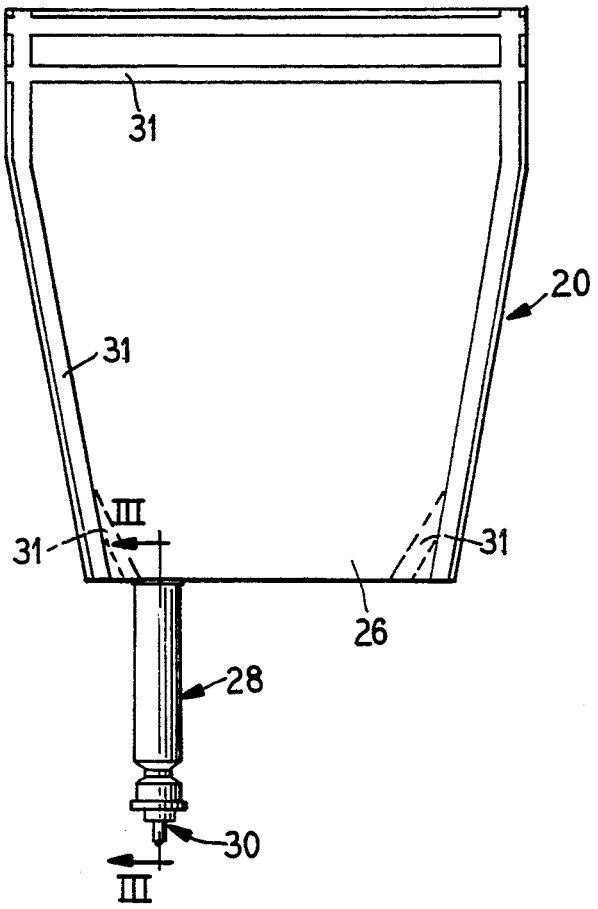
FIG. 1 is a perspective view of a pouch with a pump tube of the present invention.
Figure 2:
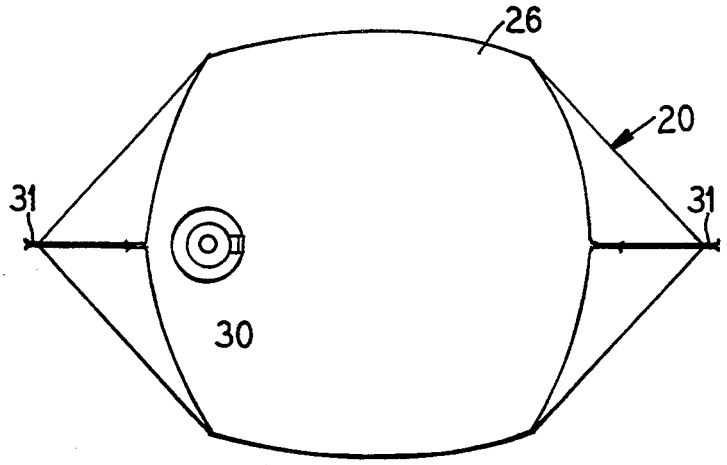
FIG. 2 is a bottom view of the pouch and pump tube as shown in FIG. 1.

The present invention provides an improved pouch and pump tube for dispensing fluids. Referring now to the figures, FIG. 1 illustrates a pouch 20 for holding liquid. The pouch is defined by a plastic body 26. The body 26 can be constructed of any plastic film, but preferably is constructed from a polyolefin. In a preferred embodiment, the body is constructed from a three layer film having an outer and inner layer of a polyethylene, polyamide. FIG. 2 illustrates the pouch 20 filled into an expanded condition. polypropylene, or blends thereof and a middle layer of a support structure such as polyamide. FIG. 2 illustrates the pouch 20 filled into an expanded condition.

Pursuant to the present invention, a pump tube 28 is sealed directly to the body 26, as described in U.S. Pat. No. 4,452,378. As described in copending U.S. Ser. No. 07/826,065, filed Jan. 27, 1992, now U.S. Pat. No.

524,208 the pouch 20 is loaded into a dispensing mechanism. A device squeezes the pump tube 28 to dispense incremental amounts of liquid through the nozzle 30.

Figure 3:
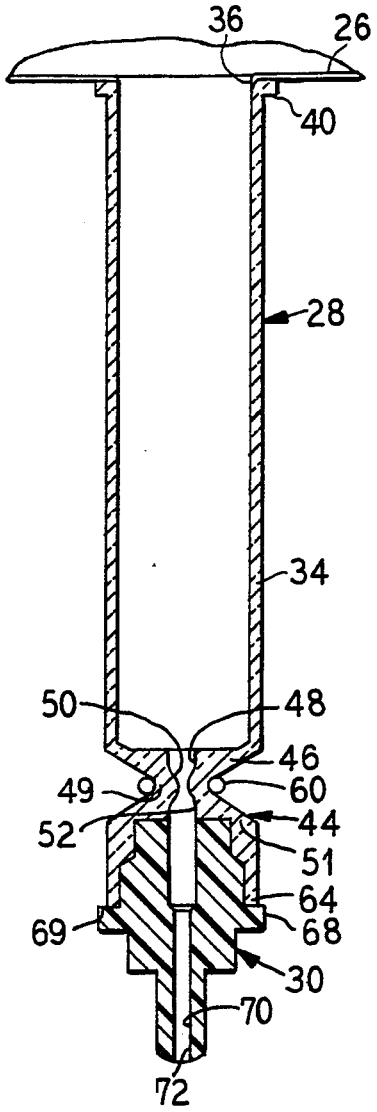
FIG. 3 is an enlarged sectional view taken generally along lines III—III of FIG. 1.

FIG. 3 illustrates the pump tube 28 in more detail. The pump tube 28 comprises an elongate tube 34 which according to the invention is preferably made of a polypropylene/butyl rubber composition such as that disclosed in U.S. Pat. No. 4,916,180, the disclosure of which is hereby incorporated by reference. In an embodiment, the composition has been treated with a peroxide curing agent. Preferably, the pump tube comprises 20 to 45 parts by weight thermoplastic polypropylene, 80 to 55 parts by weight butyl terpolymer rubber, 5 to 60 parts by weight oil and 2 to 20 parts by weight of a reinforcing filler. It has been found that the use of this material allows the tube to be directly sealed to the body 26 without fitments or couplers.

Figure 4:
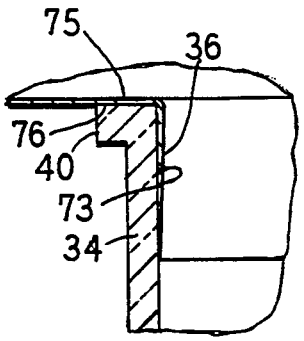
FIG. 4 is an enlarged partial sectional view of a pouch/pump tube interface as shown in FIG. 3.

As illustrated in FIGS. 3 and 4, the body 26 extends and provides a short film nozzle portion 36 which interfits inside the tube 34 at a top end thereof and is sealed against an inside of the tube 34. Due to the use of compatible polyolefin materials, the body and tube can be sealed together using a swage technique. The tube 34 provides a flange 40 around a top end thereof to fit tightly against the body 26 around the nozzle portion 36. The tube 34, at an opposite end to said flange 40, has a check valve assembly 44 which comprises a reducing section 46 having a central aperture 48 therethrough, a neck region 49 having a tapered aperture 50, and an increasing section 51 having a second aperture 52 therethrough aligned with and communicating to said first aperture 48 via the tapered aperture 50 in the neck region 49. The first aperture 48, the tapered aperture 50 and the second aperture 52 form a venturi shaped pathway.

Surrounding the intersection between the reducing section 46 and the increasing section 51, and located outside of the tapered aperture 50 is a resilient ring 60 which, absent pressure in the pump tube 28, constricts the tapered aperture 50 closed. Upon application of liquid pressure in the pump tube, the tapered aperture 50 is forced open against the resilient force of the ring 60 to stretch open the ring 60 and allow liquid to pass through the first aperture 48, the tapered aperture 50 and the second aperture 52.

The increasing section 51 extends into a socket section 64. The nozzle assembly 30 fits tightly within the socket section 64. The nozzle assembly 30 provides a fitting flange 68 which abuts an outer surface 69 of the socket section 64 upon full insertion of the nozzle assembly 30 into the socket section 64. The nozzle assembly 30 provides a central through aperture 70 for delivery of liquid from the second aperture 52 to a nozzle aperture 72 to be dispensed.

Figure 5:
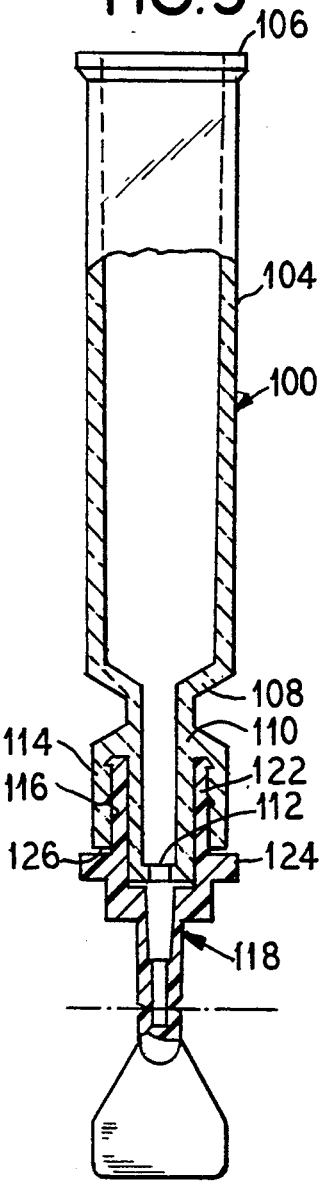
FIG. 5 is a partial sectional view of another embodiment of the pump tube shown in FIG. 3.

FIG. 5 illustrates another embodiment of the pump tube 100. In this embodiment, the pump tube 100 includes a tube 104 that has a flange 106 at a top end thereof and a reducing section 108 at a bottom end which tapers into a dispensing cylinder 110. At an opposite end is located a duck bill check valve 112 illustrated in more detail in FIGS. 6 and 7. Surrounding the cylinder section 110 is a receiving socket 114 which provides an annular female socket 116 defined between the socket 114 and the cylinder 110, also illustrated in more detail in FIGS. 6 and 7. A nozzle assembly 118 having a male engagement plug 122 and a stop flange 124 is inserted into the annular female socket 1 ! 6 until the stop flange 124 abuts a facing edge 126 of the receiving socket 114. The nozzle section 118 is illustrated in more detail in FIGS. 8 and 9.

Figure 6:
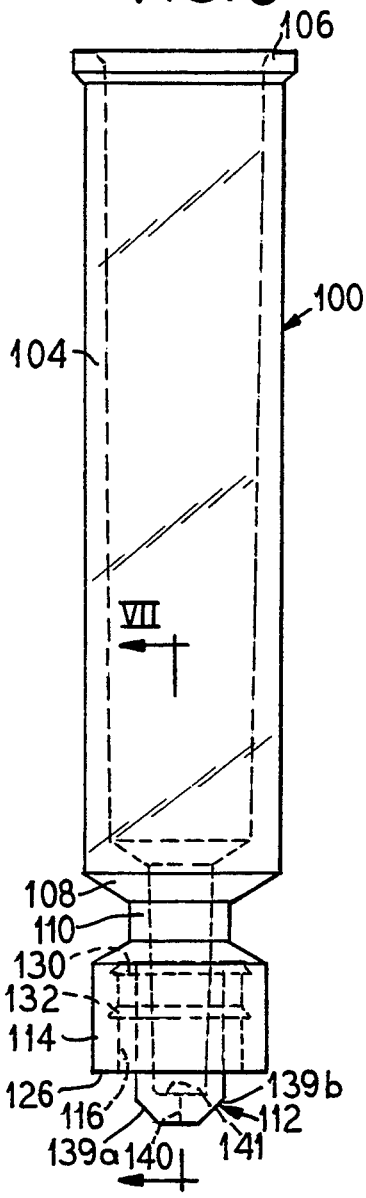
FIG. 6 is an enlarged elevational view of a component of the tube of FIG. 5.
Figure 7:
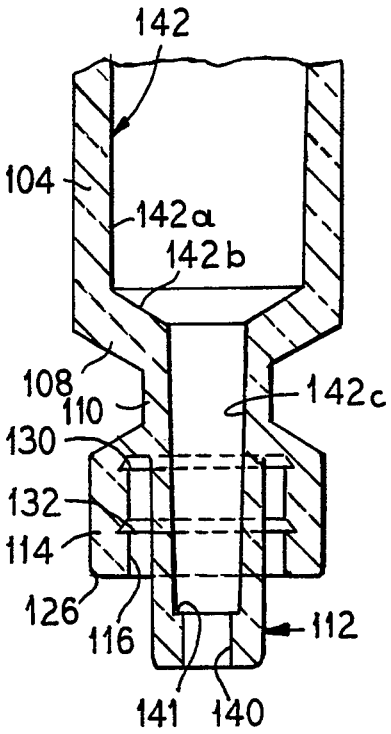
FIG. 7 is a partial sectional view taken generally along lines VII—VII of FIG. 6.

Referring now to FIGS. 6 and 7, the pump tube 100 is illustrated in more detail. Inside the receiving socket 114, annular grooves 130, 132 having right triangular profiles are provided. The annular grooves 130, 132 receive annular rings 134, 136 having a right triangle cross section arranged on the nozzle assembly 118 respectively as shown in more detail in FIG. 8. The combination of grooves 130, 132 and rings 134, 136 hold the nozzle assembly 118 into the receiving socket 114.

As illustrated, the duck bill check valve 112 has tapers 139*a,b* at its leading end in the plane of FIG. 6. A slit 140, shown closed, is provided through a bottom wall 141 of the cylinder section 110. When the pressure in the cylinder section 110 is raised by the pump tube to a sufficient degree, the slit 140 is spread open and an incremental amount of liquid passes therethrough. Upon retraction of the mechanism which had therebefore squeezed the pump tube, a suction is created in the tube which causes any liquid material still remaining at the nozzle to be sucked back before the slit 140 closes. This "suck back" prevents drips at a nozzle aperture 172 described in FIG. 8.

In the embodiment illustrated in FIG. 7, the slit 140 extends only across a partial width of the check valve 112. The check valve is not tapered in the plane of FIG. 7. An axial channel 142 is provided in the tube 104. The channel 142 has a barrel section 142*a*, a funnel section 142*b*, and a slightly tapered channel section 142*c*. The tapered channel section 142*c* terminates at the bottom wall 141.

Figure 8:
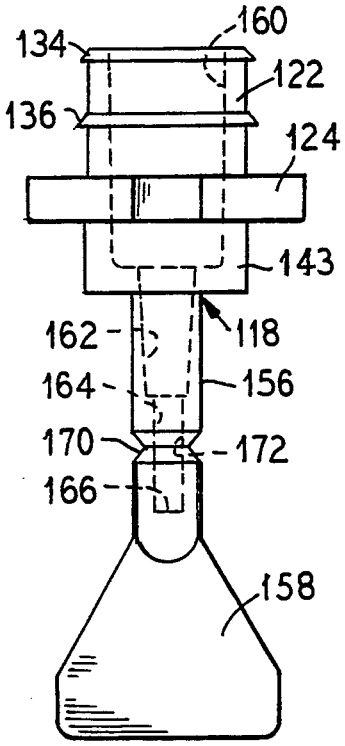
FIG. 8 is an enlarged elevational view of the nozzle shown in FIG. 5.
Figure 9:
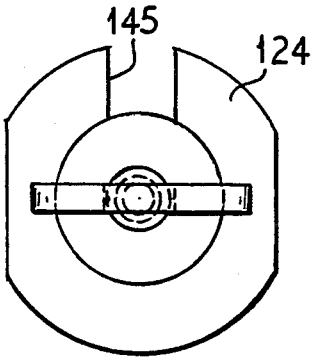
FIG. 9 is a bottom view of the nozzle shown in FIG. 8.

FIGS. 8 and 9 illustrate the nozzle assembly 118 having the male engagement plug 122 with the annular rings 134, 136 and the stop flange 124 arranged therearound. The stop flange 124 is a C-shaped ring surrounding a body portion 143 which is axially continuous with the male engagement plug 122. The stop flange has a notch 145 which can be used for orienting the tube within the dispensing mechanism. The body portion 143 extends into a reduced tubular section 156 which terminates in a finger tab portion 158. The nozzle assembly 118 provides a first central channel 160 which opens into a second reduced conical channel 162 which opens into a third tapered channel 164. The third channel 164 terminates in a closed end wall 166, thus preventing any passage of fluid through the nozzle assembly 118.

Arranged around an outside of the tubular section 156 is a reduced diameter section or annular notch 170. By grasping the finger portion 158 and breaking the tubular section 156 at the notch 170, the third channel 164 is opened, forming the nozzle aperture 172 for use in dispensing liquid therethrough. Thus, for storage of a liquid filled pouch without leaking, the invention provides a sealed nozzle section which can be opened readily to actuate the device.

Figure 10:
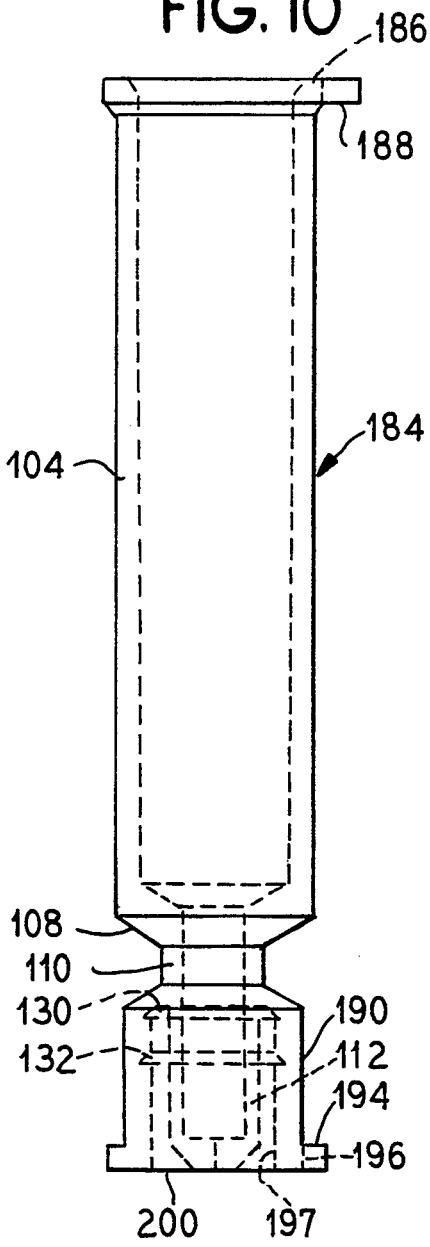
FIG. 10 is an elevational view of another embodiment of the pump tube of the present invention.

FIG. 10 illustrates another embodiment of the pump tube 184 of the present invention. In this embodiment, a top flange 186 provides a rectangular tab 188 extending on one side radially of the flange 186. This tab is useful in orienting the pump tube 184 within a dispensing apparatus. At an opposite end of the pump tube 184, a modified socket 190 is used which extends further lengthwise than the previously described socket 114. The modified socket 190 extends to a face 200 which is approximately equal to the extension of the check valve 112. A flange 194, approximately circular, is arranged at this face 200. A notch 196 is provided in the flange 194 which is similar in shape to the notch 145 shown in FIG. 9. The notch 196 is rectangular and can be used to orient the pump tube 184 within the dispensing mechanism. A female socket 197 is defined between the check valve 112 and the socket 190.

Figure 11:
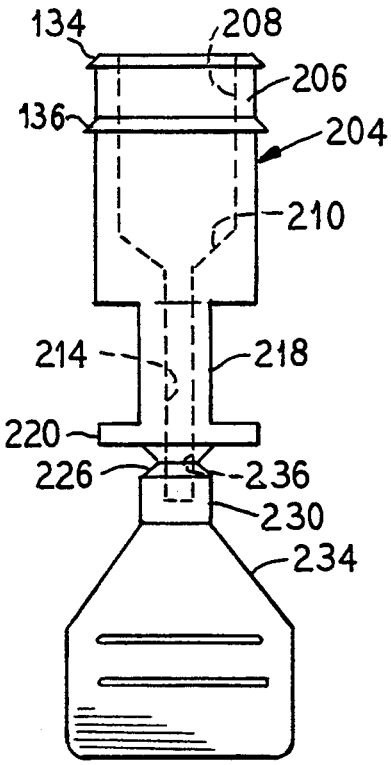
FIG. 11 is an enlarged view of an embodiment of a nozzle for installation into the pump tube of FIG. 10.

FIG. 11 illustrates another embodiment of a nozzle assembly 204. In this assembly, a cylindrical housing 206 having an axial channel 208 arranged therein is adapted to be interfit into the female socket 197 as described in FIG. 10. As previously described, the notches 130, 132 engage with the ribs 134, 136 to hold the nozzle assembly 204 within the socket 190. The channel 208 tapers in a reducing area 210 into a straight channel 214.

A cylinder section 218 is connected to the body 206. The cylinder section 218 is axially penetrated by the channel 214. A flange 220 surrounds the cylinder section 218 at a position along its length. On an opposite side of the flange 220 from the cylinder section 218, is a notch region 226 which is adapted to be broken as described previously with respect to the notch 170 of FIG. 8. A cap portion 230 arranged on an opposite side of the notch region 226 from the flange 220 closes the channel 214 preventing any flow therethrough. The cap 230 is connected to a finger tab portion 234. The tab portion 234 is used to break the notch region 226 to open a dispensing aperture 236 for passing liquid therethrough.

It should be understood that various changes and modifications to the presently preferred embodiments described herein will be apparent to those skilled in the art. Such changes and modifications can be made without departing from the spirit and scope of the present invention and without diminishing its attendant advantages. It is therefore intended that such changes and modifications be covered by the appended claims.

I claim as my invention:

1. A pouch for holding and dispensing incremental amounts of liquid, comprising:

a body section for holding a supply of liquid;

a pump tube arranged to be squeezed by a dispensing device and having a nozzle at an end thereof for passing the incremental amounts of liquid therefrom, the pump tube having a tube section connected to the body section and in fluid communication with an interior of the body section, the tube section being constructed from a composition containing a butyl terpolymer rubber and polypropylene and the body section comprising a polyolefin material at a region connected to the tube section, said body section material at the region being compatible with the composition of the tube section for direct sealing thereto.

2. The pouch of claim 1, wherein the composition comprises:

20 to 45 parts by weight of polypropylene;

55 to 80 parts by weight of butyl terpolymer;

5 to 60 parts by weight of oil; and 2 to 20 parts by weight of a reinforcing filler.

3. The pouch of claim 1 wherein the tube section transitions into a cylinder section having a exit slit at an opposite end thereof, the exit slit normally closed but openable by peristaltic pressure to pass an incremental amount of liquid therefrom.

4. The pouch of claim 3 wherein the nozzle comprises a elongate nozzle assembly connected to the cylinder section, the nozzle assembly having a through channel in flow communication with the exit slit, and a dispensing aperture.

5. The pouch of claim 4 wherein the cylinder section provides a socket connector having an annular female plug formation and the nozzle assembly having an extending male plug section pluggable into the annular female plug formation to connect the cylinder section to the nozzle assembly.

6. The pouch of claim 1 wherein the tube section comprises an outwardly directed annular flange at a first end thereof adjacent the body section, and the region of the body section comprises a film nozzle portion sized and shaped to closely fit within the tube section and adhered to an inside circumference of said tube section.

7. A pouch for holding and dispensing incremental amounts of liquid, comprising:

a body section for holding a supply of liquid;

a pump tube arranged to be squeezed by a dispensing device and having a nozzle at an end thereof for passing the incremental amounts of liquid therefrom, the pump tube having a tube section connected to the body section and in fluid communication with an interior of the body section, the tube section being constructed from a composition containing a butyl terpolymer rubber and polypropylene; and wherein the pump tube comprises a valve section, and wherein the tube section is connected to the valve section, the valve section having a narrowed passage therethrough open to the tube section at one end and to the nozzle at an opposite end, the valve section surrounded by a resilient ring, constriction of the ring closing the narrowed passage, and peristaltic pressure opening the narrowed passage to dispense said incremental amount of liquid therefrom.

8. The pouch of claim 1 further comprising a finger tab portion with a closure for the nozzle and a frangible joint located between the finger tab portion and the tube section, manipulation of the finger tab portion breaking the frangible joint to open said nozzle for delivery of said liquid therefrom.

9. A pouch for holding and dispensing incremental amounts of liquid, comprising:

a film body section for holding a supply of liquid;

a pump tube designed to be squeezed and collapsed by a dispensing device and of sufficient thickness to resiliently rebound from being collapsed and having a nozzle at an end thereof for passing the incremental amounts of liquid therefrom, the pump tube having at least a portion thereof sealed directly to the body section at a connection region of the body section, the pump tube being in flow communication with an interior of the body section, the portion of the pump tube comprising a first polyolefin material, and the connection region of the body section comprising a second polyolefin material that is compatible so as to be directly sealable to the first polyolefin material.

10. The pouch of claim 9, wherein the first polyolefin material and the second polyolefin material are not identical.

11. The pouch of claim 9, wherein the pump tube comprises a cylinder having a thickness greater than a film thickness of said body section, the thickness of said pump tube selected to create a structural memory in the pump tube after being squeezed by the dispensing device.

12. A pouch for holding and dispensing incremental amounts of liquid, comprising:

a body section for holding a supply of liquid;

a pump tube arranged to be squeezed by a dispensing device for passing the incremental amounts of liquid therefrom, the pump tube having a tube section flow connected to said body section, and a check valve section flow connected to the tube section, formed integrally with the tube section and having a wall with a normally closed slit, said wall having a flexibility for said slit to be spread openable by peristaltic pressure caused by the squeezing of the pump tube, and a nozzle section, the nozzle section terminating in an aperture, the nozzle section and said check valve section having interlocking means therebetween for connecting the nozzle section to the check valve section;

wherein the tube section comprises 20 to 45 parts by weight of thermoplastic polypropylene and 80 to 55 parts by weight of butyl terpolymer rubber and the body section comprises a polyolefin material at a region connected to the tube section, said body section material at the region being compatible with the composition of the tube section for direct sealing thereto.

13. The pouch of claim 12, wherein the check valve section comprises:

a cylinder section transitioning into said tube section, a closed end of said cylinder section comprising said wall having said slit formed therethrough;

a socket connector surrounding said cylinder section; and the nozzle section having a plug for engaging into the socket connector and having an axial channel terminating at the aperture.

14. The pouch of claim 13, wherein the interlocking means comprises a radially extending rib on an outside of said plug and a radially arranged groove on an inside of the socket connector which corresponds to the rib of the plug, the rib interlocking upon insertion of the plug into the socket connector to hold the nozzle section to the cylinder section.

15. The pouch of claim 12, wherein the aperture is covered by a cap having a finger tab portion extending therefrom, and the cap connected to the nozzle section by a frangible joint, the finger tab portion arranged and adapted to break the frangible joint to open said aperture.

16. The pouch of claim 12, wherein the tube section comprises a thicker material than the body section, the tube section retaining resilient structural memory after being squeezed, the tube section having an annular flange at the connection to the body section, and said body section having a film nozzle extending into the tube section, at the connection to the tube section, the film nozzle sealed against an inside surface of the tube section.

17. The pouch of claim 16, wherein the tube section further comprises 2 to 20 parts by weight of a reinforcing filler.

18. The pouch of claim 12, wherein the tube section comprises a flange pressed against a bottom of said body section, and the body section comprises a film nozzle portion extending downwardly into the tube section and sealed to an inside surface of the tube section.

19. A pouch for holding and dispensing incremental amounts of liquid, comprising:

a body section for holding a supply of liquid;

a pump tube arranged to be squeezed by a dispensing device for passing the incremental amounts of liquid therefrom, the pump tube having a tube section flow connected to the body section, and a check valve section connected to the tube section and having a closable aperture, the closable aperture for regulating flow from the tube section through the check valve section, and a resilient O-ring surrounding the check valve section for normally closing the aperture, the aperture openable to overcome the constriction by the resilient O-ring by peristaltic pressure caused by the squeezing of said pump tube, the check valve section flow connecting said tube section to a discharge nozzle of the pump tube.

20. The pouch according to claim 19, wherein the check valve section is formed integrally with the tube section.

21. The pouch of claim 19, wherein the tube section comprises:

20 to 45 parts by weight of thermoplastic polypropylene;

80 to 55 parts by weight of butyl terpolymer rubber;

5 to 60 parts by weight of oil; and 2 to 20 parts by weight of a reinforcing filler.

* * * * *